US011155949B1

(12) United States Patent
Negrin et al.

(10) Patent No.: US 11,155,949 B1
(45) Date of Patent: Oct. 26, 2021

(54) SYSTEM AND METHOD FOR PROACTIVE DYEING FOR CELLULOSIC AND CELLULOSIC BLENDED TEXTILES

(71) Applicant: NANO-DYE TECHNOLOGIES, LLC, Boca Raton, FL (US)

(72) Inventors: Lon Negrin, Boca Raton, FL (US); Norbert Max Büschel, Mexico City (MX)

( * ) Notice: Subject to any disclaimer, the term of this patent is extended or adjusted under 35 U.S.C. 154(b) by 0 days.

(21) Appl. No.: 16/214,096

(22) Filed: Dec. 9, 2018

Related U.S. Application Data

(63) Continuation-in-part of application No. 16/029,626, filed on Jul. 8, 2018, now abandoned, which is a continuation of application No. 15/951,028, filed on Apr. 11, 2018, now abandoned, which is a continuation of application No. 15/872,376, filed on Jan. 16, 2018, now abandoned, which is a continuation of application No. 15/800,269, filed on Nov. 1, 2017, now abandoned, which is a continuation of application No. 15/691,071, filed on Aug. 30, 2017, now abandoned, which is a continuation of application No. 15/628,701, filed on Jun. 21, 2017, now abandoned, which is a continuation of application No. 15/482,762, filed on Apr. 8, 2017, now abandoned.

(60) Provisional application No. 62/320,027, filed on Apr. 8, 2016.

(51) Int. Cl.

| | |
|---|---|
| ***D06B 3/10*** | (2006.01) |
| ***D06B 3/18*** | (2006.01) |
| ***D06B 23/02*** | (2006.01) |
| ***D06B 19/00*** | (2006.01) |
| ***D06P 3/02*** | (2006.01) |
| ***D06B 23/16*** | (2006.01) |

(52) U.S. Cl.
CPC ..... *D06B 3/105* (2013.01); *D06B 3/18* (2013.01); *D06B 19/0064* (2013.01); *D06B 23/021* (2013.01); *D06B 23/16* (2013.01); *D06P 3/026* (2013.01); *D06B 2700/02* (2013.01); *D06B 2700/09* (2013.01)

(58) Field of Classification Search
CPC ..... D06B 3/105; D06B 3/18; D06B 19/0064; D06B 23/021; D06B 23/16; D06B 23/026; D06B 27/002; D06B 27/09; D06P 3/026
See application file for complete search history.

(56) References Cited

U.S. PATENT DOCUMENTS

| | | | | | |
|---|---|---|---|---|---|
| 3,263,458 | A * | 8/1966 | Cohn | D06B 3/10 | 68/22 R |
| 3,862,554 | A * | 1/1975 | Amidon, Jr. | D06B 15/005 | 68/22 R |
| 4,586,222 | A * | 5/1986 | Catallo | D06C 5/00 | 26/51.3 |
| 4,624,036 | A * | 11/1986 | Diggle, Jr. | D06C 5/00 | 26/51.4 |
| 5,311,626 | A * | 5/1994 | Strahm | D06B 3/26 | 68/13 R |
| 5,546,622 | A * | 8/1996 | McAlister | D06B 1/02 | 68/205 R |
| 6,663,678 | B2 * | 12/2003 | Strudel | D06C 5/00 | 26/85 |
| 6,826,931 | B2 * | 12/2004 | Catallo | D06B 3/105 | 68/13 R |

* cited by examiner

*Primary Examiner* — Amina S Khan
(74) *Attorney, Agent, or Firm* — Daniel S. Polley, P.A.

(57) ABSTRACT

A system and method for cationization of textiles preferably starting with the dry raw greige tubular or open width goods that are made from either a cellulosic or cellulosic blended fabric are described. The system can include an inducer apparatus with chemical dosification system. In a preferred embodiment, the dry tubular goods are sent in a flat configuration to a first impregnation tank where it receives a multi-functional reaction fluid. After leaving the first impregnation tank, the now wet fabric is turned (when in a tubular width fabric form) by a turning unit and then sent to a second impregnation tank where it again is exposed to the multi-functional reaction fluid. The turning of the fabric causes the side edge positions of the flat tubular fabric to change its physics dynamics which allows for the multi-functional reaction fluid to be evenly applied to the entire fabric. Turning is not needed for open with fabric as it is flat, thus having only one dynamic when analyzed with physics.

23 Claims, 7 Drawing Sheets

FIGURE 7 - Flat movement with roll up on A-Frame
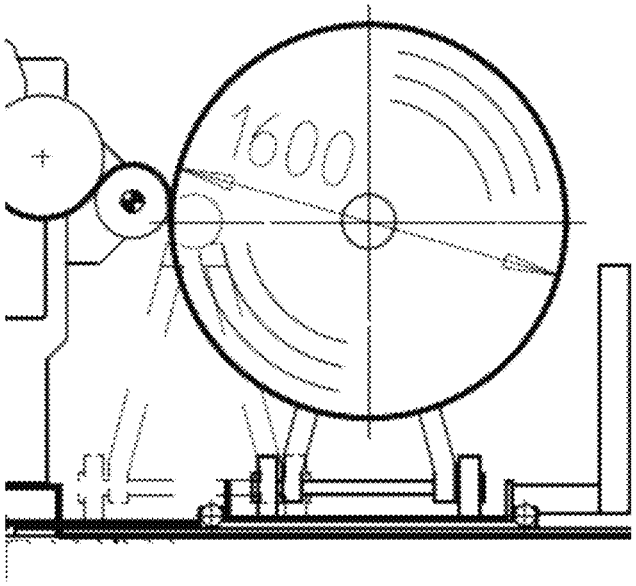

SYSTEM AND METHOD FOR PROACTIVE DYEING FOR CELLULOSIC AND CELLULOSIC BLENDED TEXTILES

This application is a continuation-in-part of U.S. application Ser. No. 16/029,626, filed Jul. 8, 2018, which is a continuation of U.S. application Ser. No. 15/951,028, filed Apr. 11, 2018, which is a continuation of U.S. application Ser. No. 15/872,376, filed Jan. 16, 2018, which is a continuation of U.S. application Ser. No. 15/800,269, filed Nov. 1, 2017, which is a continuation of U.S. application Ser. No. 15/691,071, filed Aug. 30, 2017, which is a continuation of U.S. application Ser. No. 15/628,701, filed Jun. 21, 2017, which is a continuation of U.S. application Ser. No. 15/482,762, filed Apr. 8, 2017, which claims the benefit of and priority to U.S. Provisional Patent Application Ser. No. 62/320,027, filed Apr. 8, 2016. All applications, now abandoned, are incorporated by reference in their entireties for all purposes.

FIELD OF THE DISCLOSURE

The field of the disclosure relates to commercialized production for cellulose fabric and cellulosic blend fabric, and more particularly to a turn key system, process and method using cationization of textiles starting with the open or tubular width of knit or woven greige goods that are made from either a cellulosic or cellulosic blended fabric. The end result will create a feasible commercial price effective method the dye cellulosic and cellulosic blended fabric in a much more sustainable and resourceful process.

BACKGROUND

Due the excellent properties of cellulose fabrics like durability, high water absorbency, air permeability, no static, hypoallergenic, soft touch, cellulose fabric is one of the most produced fiber in the textile industry. It is also one of the mostly water intensive fiber to process in the industry. Especially in the pretreatments and dyeing of cellulose fibers, the water usage and the high volumes produced effluents with high COD, BOD, TDS, TSS, pH and color thus creating potential environment problems for the industry.

The most commune dyestuffs for cellulosic in the exhaust process are the reactive dyes. These dyes have a poor affinity to the cellulose and a high number of electrolytes is needed to overcome this negative potential between fiber and dyes. To complete the reaction between dyestuff and fiber, a high addition of alkali is also needed. It is not uncommon that 15% to 35% of the used dyestuff does not react with the cellulosic and ends up in the effluent.

To address these problems, it has been suggested to make changes when applying a cationic polymer into the fiber. These compounds react mainly with the alcohol groups from the cellulosic and increase the nitrogen content from the fiber. This etherifying of cotton is mostly done with tertiary amino or with a quaternary ammonium reagent in an alkali medium. In the field, this process is referred to as cationization of the cellulose. Over the past 30 years, various compounds for this purpose have been found and investigated.

The reactive cationic reagents used for cationization of cotton can be divided into many groups with monomeric reagents and polymeric reagents, being just two non-limiting examples. Perhaps the most common cationic reagent for pretreatment of cotton 3-chloro-2-hydroxypropyl trimethylammonium chloride (CHPTAC) has been well studied.

In this cationization mechanism (application methods) the CHPTAC itself does not react with cellulose. It should first be converted into 2,3-epoxypropyl trimethylammonium chloride (EPTAC) according to the reaction scheme. Then EPTAC would react with alcohols under alkaline conditions to form ethers. So, it can be attached to cellulose according to the reaction scheme below. With the electropositive quaternary ammonium attached to the cellulose chains, anionic dyes exhibit higher substantively towards the fiber and no salt is need it to influence the dyeing process.

A competing reaction under aqueous alkaline conditions is hydrolysis. Hence, EPTAC slowly hydrolyzes in aqueous alkaline solution to form 2,3, dihydroxy propyl trimethylammonium chloride, as shown below in a non-limiting example. The tri ethyl ammonium group however (abbreviated TMA) is susceptible to degradation when exposed to high such as that of a fabric dryer, what after dyeing the fabric, the fabric passes thru to be dried. When the TMA degrades via what popularly known as the Hoffman degradation, the TMA creates a fishy smell in the fabric that cannot be removed. Thus, with all the research done in Cationic dyeing, the fishy smell occurrences have been the main reason that this process has never made it into commercial fabric dyeing for open width and tubular width fabric. Also, dyers have had a hard time evenly applying the cationic chemistry and forced to bleach the fabric in open width form dry it and then begin the application process which has caused a cost barrier due to so many additional steps.

The process of applying the cationization chemistry needs to be fast, consistent, no side smell reactions, robust, continuous and economical. A non-limiting example of a non-limiting canonization reaction then bonding to cellulose is below.

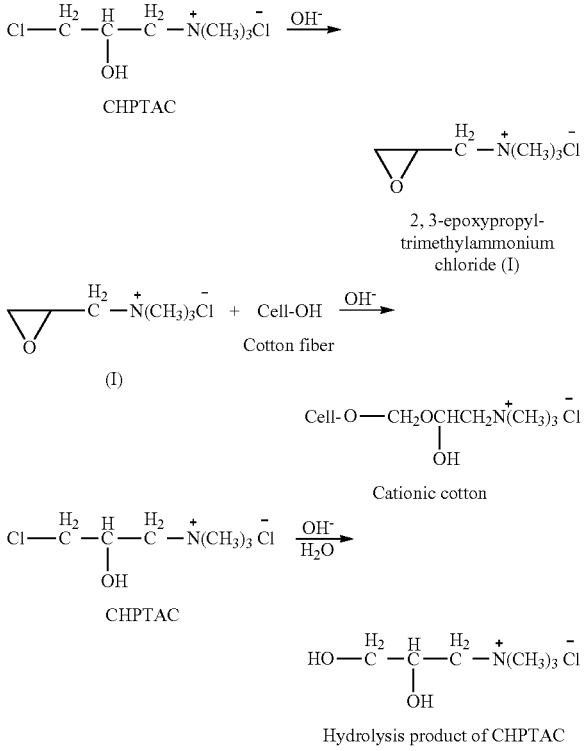

A non-limiting example of an electrostatic attraction between cationized cotton and negatively charged dye is shown below.

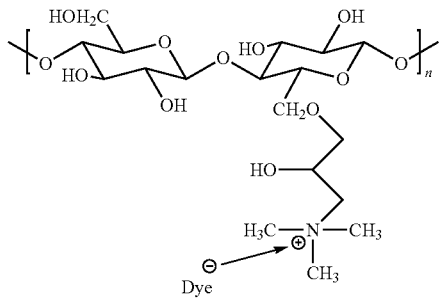

In past dyeing processes of cellulose, the anionic dyes are fixed under high alkalinity, pH 11.0 to 12.5, through hydrogen or a covalent bound with the cellulosic. In the cationized cellulosic dyeing process, the anionic dye reacts under strong ionic bond as well as covalent bond. The use of cationic reagents, such as 3-chloro-2-hydroxypropyltrimethylammonium chloride (CHPTAC), to produce cationized cotton has been a subject of increased interest due to its low cost and the ability of positively charged sites on cotton to attract negatively charged dyes. With electrostatic attractions between cationized cotton and anionic dyes, increased dye exhaustion and color yield can be obtained without adding electrolytes during dyeing. Besides higher dying efficiency and improved wet fastness properties, other advantages of cationization include shorter dyeing and after washing cycle, which results in saving of water and energy.

The cationization of cellulosic fabric with CHPTAC can be carried out by several methods or application techniques, including cold pad-batch, ionic cold pad patch, pad-bake, pad-steam, pad-dry and exhaustion. The fixation efficiency of CHPTAC on cellulosic fabrics varies greatly with the method selected, concentration of CHPTAC and alkali, time, temperature, and other variables. The cationization level on the treated cotton fabrics can be quantified by measuring the nitrogen content in the fabrics. In the industry, cold pad-batch is considered the most efficient method to apply CHPTAC to textiles in fabric form while exhaustion the least efficient. CHPTAC can be applied to cotton fiber and cotton yarn, but due to working loss, we looked at the application of CHPTAC to raw cotton fabric right after the knitting or weaving stage.

Currently the industry lacks a process for producing a bulk scale cationizing application on cellulose on open width or tubular width fabrics using the cold pad patch which chemically is the same but take different application equipment.

Cationic chemistry can contain tri methyl amines (TMA) groups which when are bonded or bonded to the cellulose are prone to degradation due to the heat of a standard textile dyer, which causing a fishy smell but there are also cationic compound which do not have TMA group and do not give off the fishy smell but have not as of yet been perfected at a cost competitive price. The uneven dyeing and smell from the drying of the fabric has prevented cationic dyeing to enter the mainstream of cellulosic and cellulosic blended knit and woven fabric dyeing. including the specialized machinery, needed chemistry and preventative novel adaptations on the specialized machinery for in plant worker safety in which the process will be accepted by worker safety commissions for use in commercial large-scale dyeing Thus, what is needed in the industry is for a process integrated system for the cationization of textiles made from cellulose and cellulosic blended fabrics. The novel system and method described below is directed to overcoming these shortcomings in current textile industry practices and equipment.

SUMMARY OF THE DISCLOSURE

A system and process are disclosed for improving the dyeability of cellulose and cellulosic blended fabric while also reducing energy consumption and CO2 emission, and solid waste, and reducing the waste water, and the degree of pollution of the waste water and the amount of fresh water being consumed to address the effluent problems associated with current industry practices. The system provides for a commercialized production process for cellulose fabric and cellulosic blend fabric, with the inducing of cationic groups and can include an inducer apparatus with chemical dosification system preferably designed for either open or tubular width fabric types. With use of the disclosed system and method, when it is time for dyeing of the fabric the anionic dye can be bonded into the cellulose fabrics in a more environment friendly and efficient approach without the use of salt, with a reduced effluent volume and shortened production time and also allowing for even dyeing with better fastness properties and no or virtually no smell on the finished dried fabric. Thus, a more economic and ecologic production commercial oriented solution to wet preparation and for the dye process for cellulosic and cellulosic blend knit fabric is provided.

The disclosed novel cationization system, can include a sophisticated application machine to make even application of the chemistry robust and worker safe, which can apply the chemistry on evenly to have an even dyeing. The related chemistry preferably wets fast, eats all the dirt and wax from the raw cotton and in dyeing can have a scent blocker, namely boric acid, to stop the TMA compound from degrading, which in turn will prevent the "fish" odor which previously came about in the drying of the wet dyed fabric.

Generally, the process includes (i) using the novel system for evenly applying a cationic polymer under alkaline condition into the cellulosic fabric, (2) rolling the treated or induced fabric up on an A-frame and allowing the cationic polymer to react with the cellulosic fiber. Afterwards, an anionic dye can be applied into the cellulosic fiber through a dyeing process using both the new anionic charge and the previous covalent bonding and a smell preventing agent in the dye exhaust machine, namely boric acid to prevent the degradation of any TMA groups if they exist to prevent the fishy smell during the final drying of the wet dyed fabric.

Some of the benefits and advantages provided by the disclosed novel system and method include (1) increasing the dyeing production capacity; (2) decreasing water usage and water pollution in the dye process; (3) reducing the effluent of the water treatment thus reducing the energy used by the dye plant or CO2 emissions; (4) reducing dyestuff consumption and sludge from the old method of having hydrolyzed dye stuff and salt; (5) improving dye shade repeatability from dye lot to dye lot; (6) no need for sodium sulfate or electrolytes during the dyeing process; (7) reducing the softener in the after treatment; (8) minimizing or reducing fabric loss; (9) increasing fabric stability; (10) the fabric has less pilling; (11) a nicer appearance is provided for the finished fabric similar to mercerized cotton; (12) improved wrinkle recovery for the finished fabric; and (13) same or improved fastness properties for the finished fabric.

The prepared fabric for the novel cationizing process described herein can be preferably, but is not necessarily limited to, (a) in open width or tubular width form; (b) knitted or woven fabric; (c) 100% cellulosic or a cellulosic blends, having, but not limited to, a minimum of 30% cellulosic; (d) dry, greige, pre-scoured, pre-bleached, pre-headset or enzyme treated; and (e) in roll or in flat form.

As will be described further detail below in connection with the drawings, the novel cationization system can include the following non-limiting components/parts/features:

(a) A fabric feeding unit for detwisting, spreading and forwarding tubular width fabric for inducing prior to dyeing. In a spread configuration the tubular fabric is preferably forwarded in a substantially flat configuration to define an initial set of edges located on each side of the flatted fabric. Preferably, the goods to be cationized are raw dry greige goods.

(b) At least one chemical impregnation tank and preferably at least two chemical impregnation tanks. The first chemical impregnation tank can be in communication with the fabric feeding unit to receive the tubular fabric from the fabric feeding unit. The first chemical impregnation tank has or defines a first interior area which contains a first amount of a multi-functional reaction fluid.

(c) Fluid coming from a mixer into the first interior area can be chilled. As such, the first chemical impregnation tank can maintain the lower temperature of the multi-functional reaction fluid.

(d) With textiles in tubular width form a first blowing air unit for ballooning the fabric impregnated with the multi-functional reaction fluid to increase penetration and evenness of the multi-functional reaction fluid as well as taking out any wrinkles in the fabric prior it to being squeezed after it exits the first impregnation tank, being squeezed and prior to being turned by a turning unit discussed more below.

(e) A first rubberized squeezing rollers unit/assembly having pressure control pistons can be positioned after the first air blowing unit of the first chemical impregnation tank. The fabric impregnated with the multi-functional reaction fluid from the first impregnation tank is fed through and squeezed by the first squeezing rollers unit prior to being received by the turning unit.

(f) A turning unit for receiving the tubular width fabric exposed to the multi-function reaction fluid after the tubular width fabric exits the first chemical impregnation tank unit. The turning unit turns the flat tubular width fabric at an angle to cause the location of the initial set of edges to now be approximately centrally located or in the middle with respect to the substantially flat fabric and no longer at an edge position. This allows the physics of the fold on the edge of the fabric to now be transformed to the physics of flat fabric. Thus, continued travel and turning of the flat tubular width fabric causes or creates different areas of the tubular width fabric to become the new set of edges on each side of the traveling flat tubular width fabric allowing for the induced chemistry to be evenly applied. Though not considered limiting, the angle of turning can be a 90° degree angle or about 90°-degree angle, however, other angles can be used and are also considered within the scope of the disclosure. Though not considered limiting, the position of turning unit can be built in any position in the inducing machine and other positions can be used and are also considered within the scope of the disclosure.

(g) A fabric bridge leading to the turning unit, the fabric bridge can have width measurement sensors and spreaders. Note that the inducing machine for tubular width fabric can have one or two turning units to continually change again the widths edges to the flat area and vice versa depending on the fabric. The width measurement sensors read any changes in width of the fabric after the fabric leaves the first impregnation bath. Thus, the sensors can read a new width for the fabric after it leaves the first impregnation tank or bath as the wet greige fabric will be narrower that dry greige fabric by the physics of liquid application to moving thru the greige fabric. The spreaders which guide the wet and dry fabric and are informed of the instantaneous width change of the fabric passing at rapid speeds thus adjusting, to prevent or at least reduce ripping, wrinkling or twisting of the greige fabric on its flat positioned pathway. Thus, the width measurements are used by the spreaders when guiding the fabric to prevent ripping, wrinkling or twisting of the fabric.

(h) A second chemical impregnation tank can be preferably provided and a third maybe needed which can be determined by the fabric density and thickness.

(i) Where a second impregnation tank is provided for tubular width fabric, a second blowing unit for ballooning the fabric impregnated with the multi-functional reaction fluid after it exits the second impregnation tank, which can also provide similar features, functions and purposes as the first blowing air unit.

(j) Where a second impregnation tank is provided for tubular width fabric, a second rubberized squeezing rollers unit positioned above the second blowing unit and the second chemical impregnation tank. The fabric impregnated with the multi-functional reaction fluid from the second chemical impregnation tank is fed through and squeezed by the second squeezing rollers unit.

A pump assembly can also be provided with respect to the fluid traveling to and from the interior area of the first tank and the interior area of the second tank to keep the chemistry homogenous.

A fabric winding assembly of both the open and tubular width fabric exit can also be provided for receipt and winding of fabric after the fabric has exited the second impregnation chemical tank. The assembly having an A-frame and a winder rotatably connected to the A-frame. The winder having an outer surface having a plurality of upwardly extending needles. Preferably, each of the needles has a hook portion at an outer tope end for grabbing the fabric such that the winding assembly is self-catching, and which allows the winding assembly to be started/threaded with respect to an initial fabric on a center beam of the A-frame without human intervention. The non-human intervention here is for worker safety as the fabric now contains the mixed chemistry which is proven to cause cancer. Protective nitrile gloves are used but this secondary needle application rids human contact completely. The A-frame for receiving tubular fabric can be positioned or sits on a movable floor guided by a center winder sensor of the fabric winding assembly so that winding by the winding assembly is centered to avoid air pockets along the fabric edge on edge winding. With flat fabric the A-Frame sits on a moveable floor which moves outwards as the roll enlarges by width sensors to prevent irregular pressure and air pockets.

After the fabric goes through the cationization system and preferably remains winded up the multi-functional reaction fluid bonds to the cellulose or cellulosic blended fabric as the fluid slowly warms up and over time with further warming up of the fluid one or more positive charge sites are created on the fabric for bonding with negative charge sites of a fabric dye during a dyeing process for the fabric. After a period of time, the fabric is then ready for the dyeing process.

Preferably, the multi-functional reaction fluid can have one or more of the following non-limiting characteristics: (a) a preferred temperature is not less than about 16° C. (Celsius) and not more than about 30° C.; (b) a preferred temperature variation in the bath(s)/tank(s) and over time is not less than about 20° C.; (c) the preferred pH of the bath(s)/tank(s) is over time is not less than about pH 10° C.; and (d) can preferably include one or more of the following or similar chemicals: caustic-soda, wetting agent, cracking agent, sequestering agent, dispersing agent, scouring agent preferred nonionic nature and a cationizing agent Preferably, the squeezing roll unit can have one or more of the following non-limiting characteristics: (a) a preferred hardness of about 75 to about 95 shore; (b) a preferred squeezing pressure can be set minimum by about 1 to about 7 bar; and (c) the pickup of the fluid into the fabric from the squeezing can be set with a preferred minimum of about 50% to a preferred maximum of about 120%.

Preferably, the winding system can be an axial system such as, but not limited to a center winder A-frame system, with tension controlled up winding. The center A-frame shaft can be provided with a stainless-steel needle carpet having outwardly extending needles for self-catching of the fabric by the winding system without human intervention.

The above described inducing system is preferably covered to form a "closed" system as vapors from chemical reaction can be harmful to worker. Also, the control panel is on an elbow arm device or mounted outside the closed area. Preferably, the inducing bath(s)/tank(s) can be totally covered and provided with an exhaust system. Preferably, a second cover having a clear PVC curtain can be installed in the up-winding area, with an additional aspiration system. The drained fluid from the inducing system can be collected in a separate tank where it can be neutralized with acid and an installed mixer and made harmless to the environment and/or to a form which the water treatment plant can easily eliminate.

The dyeing of the cationized cellulosic fabric can be done in the exhaust system, and in one dyeing cycle: the treatment steps can include washing, bleaching, dyeing, neutralization with a finishing pH of 5.7-5.9, with the same chemistry currently used in the current commercially used process but an adding a treatment with a scent preventing agent, namely boric acid if the cationizing and contains TMA groups to prevent the degradation of the TMA and in turn a fishy smell during standard textile drying. There are other fabric dyeing systems which can be used which use reactive dyes, but exhaust systems are the only operating fabric closed dyeing system known to date, thus recommended.

As mentioned earlier one non-limiting reactant that can be used is a CHPTAC reactant, which is a high-volume chemical that is used in the paper, food and textile industry. Sodium hydroxide can be added to the CHPTAC, which converts CHPTAC to EPTAC. Preferably, the CHPTAC (Reactant) and the sodium hydroxide (Catalysator) are kept separate from each other and preferably pumped and brought separately into two lines to the mixer for feeding the reaction. The epoxy reacts with the cellulose to yield the charged cellulose. The above non-limiting example provide a single reactive site to bond with the dyestuff. However, it is also within the scope of the disclosure to start or use other molecules that will yield multiple (two or more) reactive sites for bonding with the dyestuff. These other bi or multi-functional molecules that will yield the multiple reactive sites are also considered within the scope of the disclosure. If these cantonizing agents does not have TMA, the boric acid is not needed as the chemical structure will not degrade due to the exiting dyed fabric dryer, but boric acid can be used as it is known as a fabric smell freshener or blocker.

Additionally, the novel system can also be used with open-width knit and woven fabrics as well with an inducer without a quarter turn and also without ballooning mechanism, but the chemistry, dosification, inducing tanks, temperatures, squeezing pressures, closed system configuration and needle wind up should be the same.

Accordingly, a novel system and method are provided for cationizing cellulosic in tubular or open-width form from greige fabric; preferably raw greige fabric right from knitting for cost savings, pre-scoured greige or pre-bleached greige fabric in both forms in which it may exists, namely open width and tubular width.

BRIEF DESCRIPTION OF THE DRAWINGS

FIG. 7 is a side view of the novel open width cationization system showing the open fabric being wound on a self-catching A-Frame and moving away from the inducing machine as the impregnate raw greige fabric make the roll larger and the platform moves the A-frame future from the inducer so that the induced fabric has even pressure and tension during the in accordance with the present disclosure.

DETAILED DESCRIPTION

The disclosed and shown system and method, provides for anionic fibrous material with cationic reactive groups. Preferably, the anionic fibrous material can be cellulose or cellulosic blended fabric, which can be in the raw greige stage directly from the knitting process. The raw greige fabric could be pre-treated by being scoured or beached but is not preferred as it increases the cost of the dyed end fabric. The fabric is in dry condition and can be in rolls or in flat form. Through use of the system/method, the cellulosic or cellulosic blended fibrous fabric is first padded with a cold mixture of cationic reactant, water and other auxiliary chemicals, winded up on a self-catching A-frame, sealed air tight preferably with a plastic or other air tight material and packed with plastic tape and patched for a period to form the cationic cellulose.

Preferably, padding comprises padding a cold EPTAC chemical though dosing on the cellulose or cellulosic blended fabric through an inducing bath/tank containing EPTAC that is formed by a chemical reaction between CHPTAC and Caustic-Soda. Nonionic wetting, sequestrant detergent, cracking agents and a scent reaction preventing agent can also be included in the chemical bath, so that the fabric absorbs the chemical bath more quickly and without odor.

As seen in the Figures the fabric is fed through the various components of the novel system by various rollers, conveyors and/or pads located throughout the system.

Figure 6:
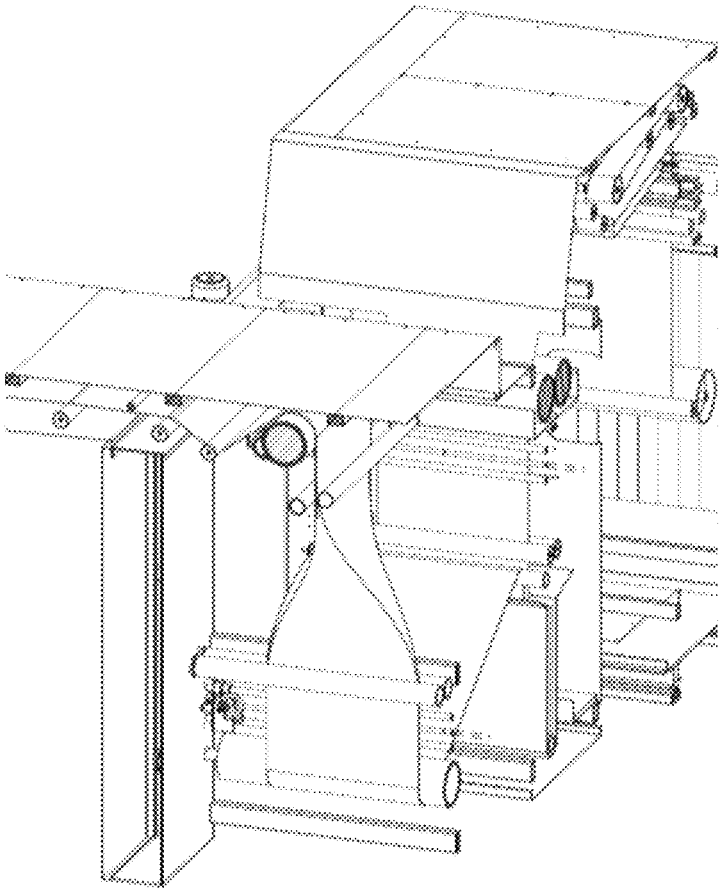
FIG. 6 is a perspective view of the novel cationization system showing the fabric being turned after the first bath being and then being fed into the second bath and with the squeezing rollers positioned above the second in accordance with present disclosure.

The padding unit or the impregnation tank can be designed for an extended fabric/chemical contact time. As best seen in FIG. 6, the inducing bath/tank can have a narrow design with a relatively low fluid volume, preferably through the positioning of a displacement block within the tank.

The reaction fluid can be preferably fed through a single pipe system from the mixer into the first impregnation tank (where the system includes multiple tanks/baths). Preferably, Preferably, the bath temperature for the fluid in the impregnation tank is set to about 16° C. to about 30° C. Grad Celsius, however other temperatures and temperature ranges can be used and are considered within the scope of the disclosure. The chemical bath can have a constant temperature range of 16° C. to about 30° C.

A pump system can also be provided to constantly move the fluid inside the bath/tank and constantly mix the fluid with new fluid coming into the tank either from the mixer or from another tank.

After passing the fabric trough the impregnation tank, the fabric can be squeezed by squeezing rollers positioned above the tan (See FIG. 6) to a pick up from a preferred minimum of about 50% to a preferred maximum of about 120%. In the preferred embodiment, the chemical bath pick-up can be constant throughout the production of the same batch of fabric to ensure uniform color retention during the dyeing phase. The squeezing rollers can with a shore hardness of about 75 to about 95. The underlining roll can be the driving roll and the upper roll can be the pressure adjustable roll. The squeezing pressure can be adjusted by regulating the air-pressure on the cylinders from about 1—about 7 bar, according to the required squeezing effect.

Figure 4:
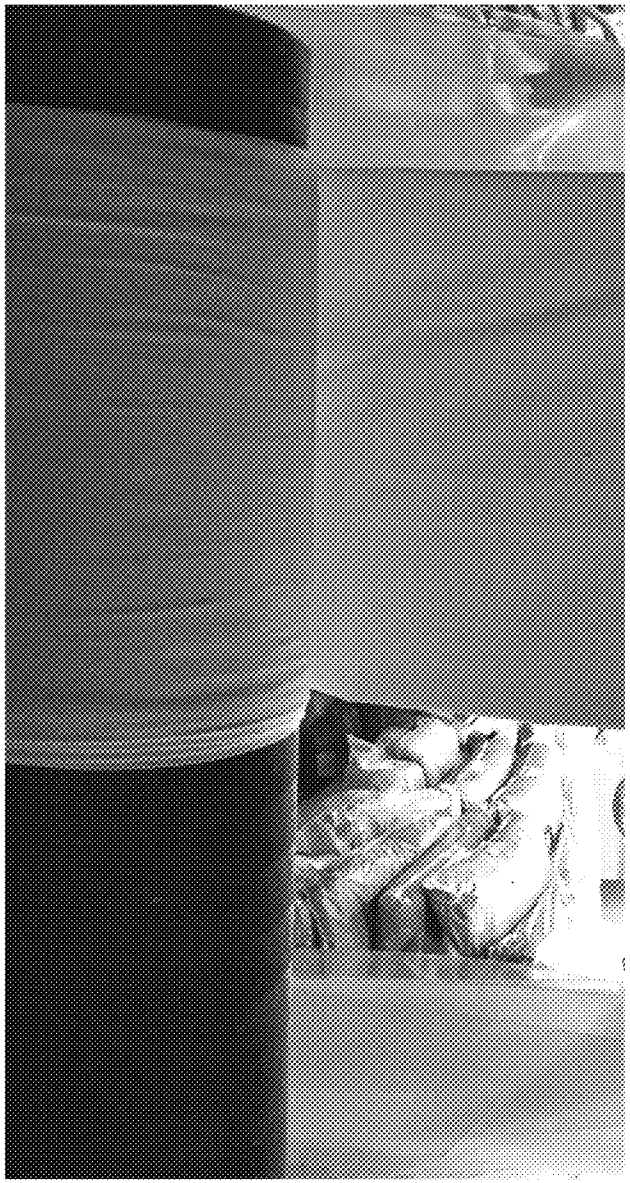
FIG. 4 is a perspective view of one non-limiting embodiment for the fabric self-catching needles of the winding assembly with raw induced greige tubular fabric in accordance with the present disclosure.

Preferably, the inducing tank(s) and their squeezing unit(s) are sealed up and covered by an enclosure preferably having an exhaust system (See FIG. 4).

To eliminate or reduce migration and contact between the treated fabric and the air, the induced fabric once finished with the cationization system can be air tight packed with plastic and sealed. The treated fabric is preferably stored for 12 to 24 hours to allow the reaction between the cellulose or cellulosic blend and the EPTAC to take place.

The cationization system (inducer) is preferably a closed machine system (see FIG. 5), having a novel injection and dosification system, tension, bath level, pressure, temperature and speed control. Preferably, the system can have a double padder and two fluid baths which are specially designed to achieve a relatively long contact time with the liquor/chemistry. A novel spreading unit is also provided which direct/turns the fabric about 45-90° to create a new edge on the flat part of the fabric while inducing tubular fabric.

The preferred two-inducing baths can be preferably connected with a pipe system in which the two-fluid bath are preferably constantly exchanging and passing the reaction fluid.

Preferably, under the squeezing rollers can be provided with a collecting trough for collecting dripping fluid caused by the squeezing of the fabric which return the collected fluid back into the bath/tank.

On the top of the inducer system a cover/enclosure can be provided for the fumes and vapor of the bath(s), preferably with an aspiration system.

Figure 1:
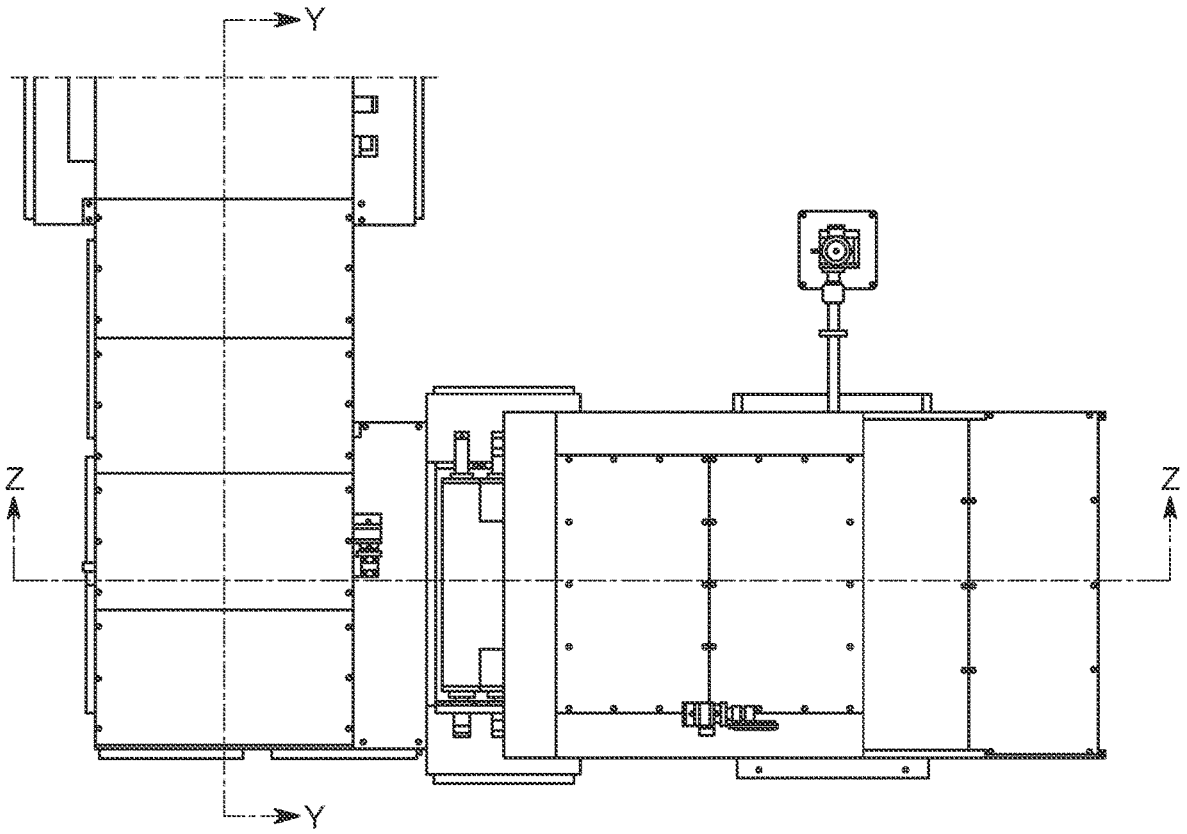
FIG. 1 is a perspective view of the novel cationization system in accordance with the present disclosure showing the turn of the inducer machine following the turning of the fabric direction by the mechanism which rotates the fabric here about 90 degrees.
Figure 2:
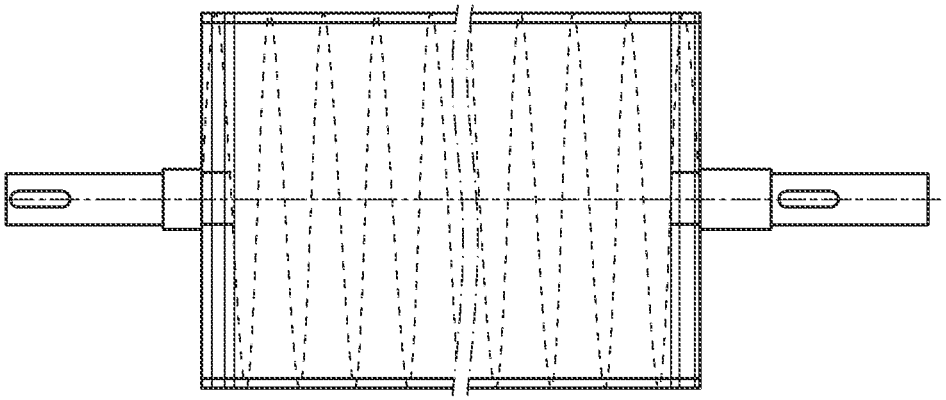
FIG. 2 is another perspective view of the novel cationization system in accordance with the present disclosure showing the A-Frame with needles positioning.
Figure 3:
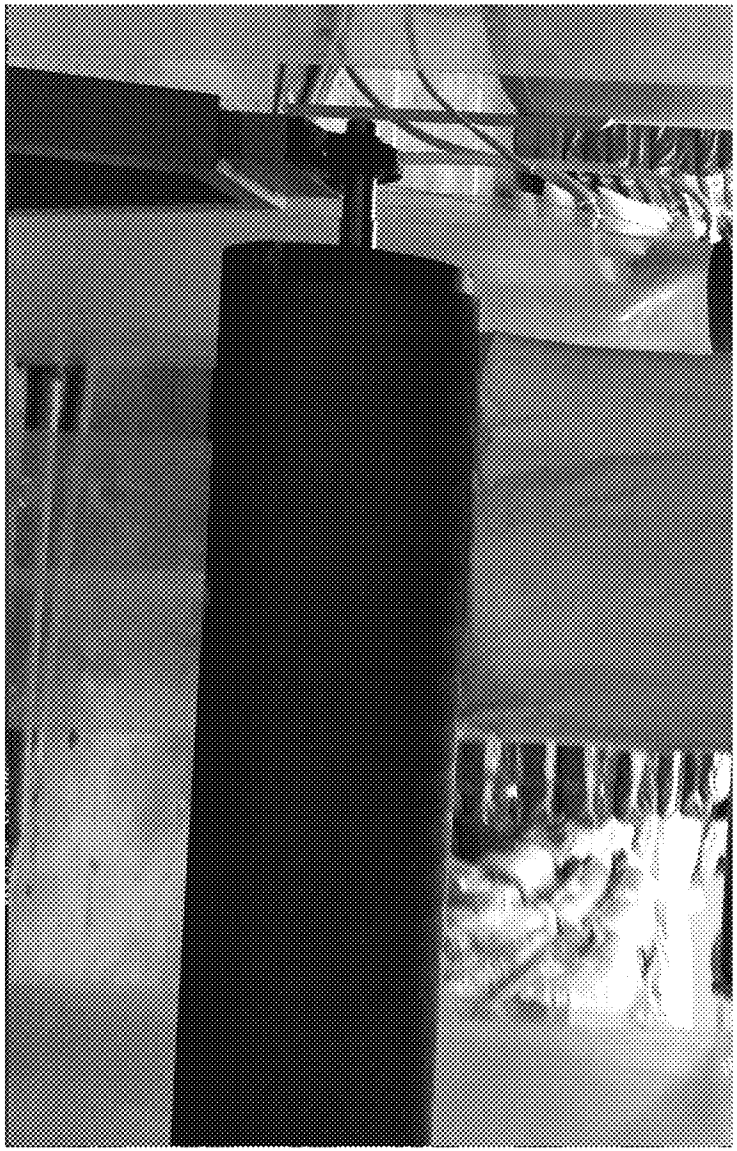
FIG. 3 is a perspective view of one non-limiting embodiment for the fabric self-catching needles of the winding assembly in the process of catching raw greige tubular fabric coming out of inducing stage in accordance with the present disclosure.

A winder assembly is provided at the exit of the machine (See FIG. 1) which can comprise a winder column with axial system installed for a center winder A-Frame. The wind-up of the fabric on the novel A-Frame can be controlled over tension measurements depending on the diameter of the fabric roll. With an installed potentiometer the speed of the winder column can be regulated, depending on the fabric roll size.

Figure 5:
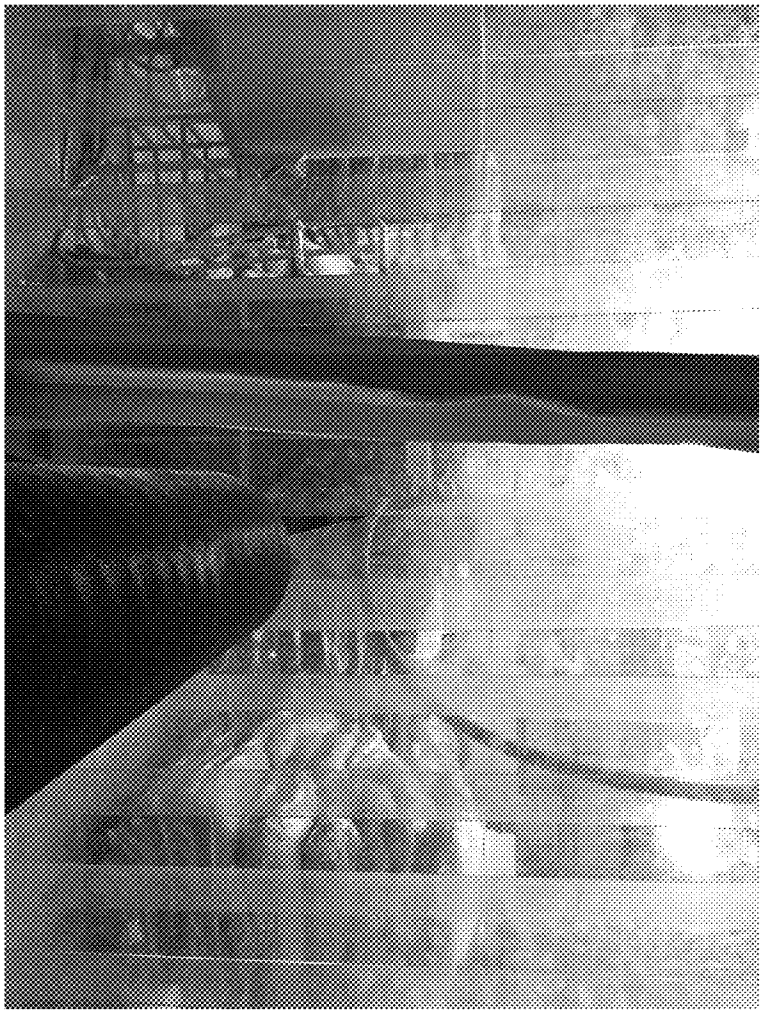
FIG. 5 is a perspective view of the novel cationization system enclosed to form a "closed" system and showing self-catching needle A-Frame in accordance with the present disclosure.

On top of the padder and winder a cover can be installed to extract all the fumes, which are produced in the process and thus allowing the system to be considered a "closed" system. As seen in FIG. 5, a clear PVC curtain can preferably be installed from top to the floor to keep the area associated with the winding system closed.

The treated fabric passes over a conveyer to the exit and the fabric is rolled up on a center A-Frame. To minimize or eliminate human touching of the fabric during operation, particularly where the fabric may be induced with aggressive chemicals, the winding assembly can be self-catching and receives the fabric without human intervention or contact of the fabric. In one non-limiting embodiment, the outer surface can be provided with a plurality of outwardly extending needles to catch the fabric. The needles can be in the form of a needle carpet (See FIGS. 2,3,4 and 5).

Preferably at the end of a conveyor at or adjacent to the winding assembly can be provide a cutting unit for automatically cutting the fabric at the end conveyor preferably after a predefined length of fabric has passed. The automatic cutting again eliminates or reduces the need for human contact with the fabric induced with the chemicals. The cutting system can pass horizontal guides from the right to the left or reverse and cut the fabric after the desired meter/length production of fabric has been achieved.

The A-frame core, where the fabric is winded, can be attached preferably with a stainless-steel zig, zag carpet. The needles can be preferably formed with a little hook on the top for grabbing the beginning of the fabric. To support this self-catching system, a swing roll, can be installed in this area pushing the fabric onto the needle carpet. The needle tape can be tabbed or otherwise secure on or to the cylinder of the A-frame.

The tubular or open width fabric can be 100% cotton or a cellulosic blends of fibers ut preferably of at least about 30% cotton.

During use of the tubular width fabric system, preferably a plurality of individual tubular width fabric rolls can be sewn together end to beginning for continuity processing of fabric through the system. Open width fabric can also be sewn together if it is fed to the inducer in a plaited format in buggies with a tail the end of the container plaited fabric hanging out of the buggy, so that the process can be continuous.

The knit fabric can be raw greige fabric directly from knitting, prebleached, pre-scoured or enzymatic treated. The fabric is in dry condition and can be in rolls or in flat form. The fabric is placed at the entry of the machine preferably in a trolley or pallet, so the fabric can be pulled with relatively little resistance to begin the process.

The fabric can be center set and spreaded with a spreading unit 30. This center set and spreading unit can be placed in many areas of the inducer. The turning unit, which preferably provides for a 45° to preferably 90° turn of the fabric is placed in this tubular inducer between the 2 bath units.

As seen in FIG. 6, after being turned, the fabric can be transported to a second impregnation tank 34, past trough a second ballooning system 35, a second spreading unit 36 and a second squeezing unit 37. With ae second transfer unit 38, the fabric can be transported tensionless to the exit of the inducing machine/system. Also, at the exit, an automatic cutting device 40 is recommended for automatically cutting the fabric after a certain length of fabric has passed through and without human contact of the fabric. A center A-frame winder 41 can be coupled with a stationary motor 42 for driving the winder. A swing roll unit 43 can be provided for pushing the fabric to the A-frame cylinder via the self-catching needle tape carpet 44.

With the open width fabric system/inducer, a centering unit at the entry of the foulard can be installed. A tension control unit at the entry and a padder can be installed to help ensure the same width of the fabric through the impregnation process. A tension control unit at the exit of the padder and the winder assembly can be installed to ensure the same width of the fabric and an even roll up on the A-Frame (see FIG. 7).

Two uncurling spiral rollers can be installed, with one unit in the entrance and the second after the fluid bath, before the squeezing unit, to ensure no edge curling of the fabric. Preferably, each chemical for the reaction fluid, such as, a wetting, cracking, dispersing agent, caustic-soda, the scent stopping agent boric acid and the cationic reactant can be dossified separate and mixed with a mixer with the chilled water before the entry of the mixed reaction fluid into the first chemical tank/bath.

The pre-treated, washed fibrous assemblies are then dyed preferably with any anionic dye. Any of the known types of anionic dyes can be suitably employed in this process. Preferably, the dyestuffs include at least one dye selected from the group comprising of direct dyes, premetallized dyes, acid dyes, sulfur dyes, vat dyes, pigment dyes, reactive dyes and natural dyes. The specific dyestuffs used may be selected depending upon the type of fabric used, the particular color desired and/or other considerations.

Some of the features, benefits and/or advantages provided by the disclosed novel open width and tubular width fabric systems and methods can include, without limitation, the following:

1. Provides an apparatus and application system for a semi-continuous or continuous open width and a tubular width continuous or semi continuous treatment of knit fibrous material of cellulosic fibers, containing a cationic polymer, wherein the ionic cross-linked fiber can be dyed in a stronger, faster, and ecologic manner.

2. The fibrous material compromises preferably raw greige although pre-bleached or pre-scoured piece goods in tubular or open width knit form are applicable to this method. The piece goods are cellulose fibers and cellulose blended fibers.

3. The circular-knit fabric is in dry stage.

4. The dyeing of cellulosic fiber can include anionic dyestuffs, without the usage of salt.

5. Producing an ionic cross-linked cationic fibrous material in the raw greige fabric stage directly from knitting or weaving in a practical and in a production manner in a cold pad-batch method. The method can include the steps of inducing mono functional or multifunctional cationic polymer with the epoxy chain attaching to the cellulosic fibers in a high alkali solution, and an example in the mono cationic polymer 2,3-epoxypropyl trimethyl ammonium chloride (EPTAC). The EPTAC can be formed from 3-chloro-2-hydroxypropyl trimethyl ammonium chloride (CHTAC) with the alkali, sodium hydroxide (NaOH). The set of the NaOH and CHTAC concentration can depend on the desired efficiency cationization and can vary. Here the boric acid is needed in dyeing to prevent TMA degradation which causes a permanent fishy smell.

6. Uses one or more inducing bath(s)/tank(s) which can contain in additional auxiliaries such as, without limitation, Cracking-Agent, Wetting-Agent, Sequestering Agent and/or Dispersing Agent, etc., to clean the dirty raw cotton fabric.

7. The active cationic (EPTAC) reacts with the hydroxyl groups of the cellulose to form a permanent bond and cationic dye site.

8. Cold Patch Padding, preferably but not limited to, the cellulosic fiber material with a wet pickup of about 50% to about 120% with squeezing rolls.

9. Batching the cellulosic fiber material over a time period from 12 hours to 24 hours at room temperature wherein the fabric can be wrapped and sealed airtight with plastic wrap to avoid evaporation and condensation.

10. The fluid bath(s)/tank(s) can have a narrow design and the open a tubular width knit fabric passes continuously through a preferred but not necessary relatively low volume fluid bath.

11. The squeezing rate from the tubular wet fabric is about 50 to about 120% and the layer of the rubber from the squeezing rolls having a shore hardness of about 75 to about 95.

12. The cylinder of the center-winder can be tapped with a stainless-steel needle tape, to provide for a fabric self-catching ability then avoiding human contact. The fabric self-catching unit can include a swing-roll to direct the fabric to the needles on the cylinder.

13. In between the exit from the inducing system and the winder apparatus an automatic cutting unit can be installed, which can be a cross cutting device to cut the treated wet fabric from the left to the right or in reverse to avoid human intervention.

14. Provides for a chemical dosing system with automatic settings, which can be connected to the fluid bath unit(s)/tank(s).

15. The dosification apparatus system can include water (which can be chilled or cooled water) and chemical tanks with a polymer with one epoxy forming site and one or more cationic forming sites, Wetting Agents, Cracking Agents, Sequestering Agents and Caustic-Soda liquid. Each chemical tank can have a separate line and a separate pump system. The chemicals pre-mixed in water can be mixed together through a mixer and then getting injected together within the interior area of the first fluid bath/tank. The mixing is inline or by separate pumps depending on cost parameter, but both provide the accuracy needed. When there are two baths/tanks, a circulation pump can be provided to keep the baths homogenous.

16. The preferred dosification apparatus system needs the incoming water temperature to be cold and consistent for the fluid reactions to be controlled.

17. In one non-limiting embodiment, the inducing unit for tubular width knit fabric can be a two bath/tank padder, which can be laid out in a Shape, preferred from 45-90° where the angle promotes the fabric to turn changing one end to a flat surface and vice-versa (thus the turning mechanism).

18. Between the two inducing baths/tanks for the tubular width knit fabric, a novel spreading/turning unit can preferably be installed but the spreading/turning unit can vary in position along the path of the inducer based on the fabric or factory space constraints.

19. With the turning of the fabric, the two original edges of the flat tubular width fabric are placed in the flat of the fabric and the previous flat of the fabric is passed into or becomes the new edges to allow for an even application of the reaction fluid on the entire fabric.

20. The turning angle can be a 45-90° degree angle and preferably 90°-degree angle, but for space constraints the range is satisfactory as to observe the turn is critical using the eye or sensors.

21. The described inducing system is preferably covered to form a "closed" system as vapors from chemical reaction can be harmful to worker. Also, the control panel can be on an elbow arm device or mounted outside the closed area. Preferably, the inducing bath(s)/tank(s) can be totally covered and provided with an exhaust system. Preferably, a second cover having a clear PVC curtain can be installed in the up-winding area, with an additional aspiration system. The drained fluid from the inducing system can be collected in a separate tank where it can be neutralized with acid and an installed mixer and made harmless to the environment and/or to a form which the water treatment plant can easily eliminate.

22. The dyeing of the CHTPAC cationized cellulosic fabric can be done in the exhaust system, and in one dyeing cycle: the treatment steps can include washing, bleaching, dyeing, neutralization with a finishing pH of 5.7-5.9, with the same chemistry currently used in the current commercially used process but adding a scent preventing agent, namely boric acid, as the cationizing chemistry and contains TMA groups. To prevent the degradation of the TMA and in turn a fishy smell during standard textile drying.

23. There are other fabric dyeing systems which can be used which use reactive dyes, but exhaust systems are the only operating fabric closed dyeing system known to date, thus recommended.

24. Producing an ionic cross-linked cationic fibrous material in the raw greige fabric stage directly from knitting or weaving in a practical and in a production manner in a cold pad-batch method. The method can include the steps of inducing mono functional or multifunctional cationic polymer with the epoxy chain attaching to the cellulosic fibers in a high alkali solution, and an example in the mono cationic polymer 2,3-epoxypropyl trimethyl ammonium chloride (EPTAC). The EPTAC can be formed from 3-chloro-2-hydroxypropyl trimethyl ammonium chloride (CHTAC) with the alkali, sodium hydroxide (NaOH). The set of the NaOH and CHTAC concentration can depend on the desired efficiency cationization and can vary. Here the boric acid is provided in dyeing to prevent TMA degradation which causes a permanent fishy smell.

25. More than one turn can be incorporated into the system depending on the fabric. Thus, the system can have one turn, two turns, etc. depending on the fabric. It within the scope of the disclosure to place the turn anywhere in the path of the inducing machine.

26. The multi-functional reaction fluid can be a cold multi-functional reaction fluid.

All measurements, dimensions, chemicals, ingredients, shapes, amounts, angles, values, percentages, materials, degrees, configurations, orientations, time periods, product layout, components or parts; component or part locations, sizes, number of sections, number of components or parts, etc. discussed above or shown in the Figures are merely by way of example and are not considered limiting and other measurements, dimensions, chemicals, ingredients, shapes, amounts, angles, values, percentages, materials, degrees, configuration, orientations, time periods, product layout, components or parts, component or part locations, sizes, number of sections, number of components or parts, etc. can be chosen and used and all are considered within the scope of the invention.

It will be seen that the objects set forth above, and those made apparent from the foregoing description, are efficiently attained and since certain changes may be made in the above construction without departing from the scope of the invention, it is intended that all matters contained in the foregoing description shall be interpreted as illustrative and not in a limiting sense. The instant invention has been shown and described herein in what is considered to be the most practical and preferred embodiment.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from their spirit and scope.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is examined, interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

Dimensions and/or proportions of certain parts in the figures may have been modified and/or exaggerated for the purpose of clarity of illustration and are not considered limiting.

While the system and method has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A system for cationization of textiles starting with dry tubular width fabric that are made from either a cellulosic or cellulosic blended fabric in a raw greige stage directly from knitting for cost efficiency, or in a pre-scoured greige or pre-bleached greige condition, the system comprising:

a fabric feeding unit for spreading and forwarding tubular width fabric for inducing prior to dyeing, wherein in a spread configuration the fabric feeding unit adapted to forward the tubular fabric in a substantially flat configuration to define an initial set of edges located on each side of the flatted fabric;

a first chemical impregnation tank in communication with the fabric feeding unit, the first chemical impregnation adapted to receive the tubular width fabric from the fabric feeding unit, the first chemical impregnation tank defining a first interior area containing a first amount of a multi-functional reaction fluid able to treat fabric in a raw greige dirty condition or in a scoured or bleached condition;

a turning unit receiving the tubular width fabric exposed to the multi-function reaction fluid after the tubular fabric exits the first chemical impregnation tank, the turning unit adapted to turn the tubular fabric at a first angle to cause the location of the initial set of edges to now be no longer at an edge position, wherein turning of the tubular fabric by the turning unit causing different areas of the tubular width fabric to become a new set of edges on each side of the traveling flat tubular fabric; and a second chemical impregnation tank in communication with the turning unit, the second chemical impregnation tank adapted to receive the turned wet tubular width fabric from the turning unit and after the turning unit has turned the wet tubular width fabric, the second chemical impregnation tank defining a second interior area containing a second amount of the multi-functional reaction fluid able to treat fabric.

2. The system for cationization of claim 1 wherein the fabric is preferably raw dry greige goods.

3. The system for cationization of claim 1 further comprising a fabric bridge leading to the turning unit, the fabric bridge having width measurement sensors and spreaders, the width measurement sensors adapted to read any changes in width of the fabric after the fabric leaves the first chemical impregnation tank to compensate for the dry moving fabric getting wet and thinner, wherein the spreaders adapted to use the width measurements and the spreaders are adapted to guide the fabric to prevent ripping or twisting of the fabric.

4. The system for cationization of claim 1 wherein a range for the first angle is about 45-90° degrees.

5. The system for cationization of claim 1 wherein the first chemical impregnation tank is in fluid communication with the second chemical impregnation tank through a first conduit providing communication between the first interior area and the second interior area and serving as an inlet for providing the second amount of the multi-functional reaction fluid into the second interior area.

6. The system for cationization of claim 5 wherein the first chemical impregnation tank is also in fluid communication with the second chemical impregnation tank through a second conduit providing communication between the first interior area and the second interior area and serving as an outlet for returning at least some of the second amount of the multi-functional reaction fluid from the second interior area back to the first interior area in order to maintain a homogenous multi-functional reaction fluid in both the first interior area and the second interior area.

7. The system for cationization of claim 1 further comprising a first blowing air unit adapted to balloon the fabric impregnated with the multi-functional reaction fluid to increase penetration, evenness of penetration and to make the fabric flat before or as the fabric goes directly into a first squeeze to prevent overlaps or twists of the wet greige fabric with the multi-functional reaction fluid after it exits the first impregnation tank and prior to being turned by the turning unit.

8. The system for cationization of claim 1 wherein the first chemical impregnation tank having a first displacing block(s) disposed within the first interior area, the first displacing block(s) adapted to reduce an available volume amount within the first interior area.

9. The system for cationization of claim 8 wherein the second chemical impregnation tank having a second displacement block(s) disposed within the second interior area, the second displacing block(s) adapted to reduce an available volume amount within the second interior area.

10. The system for cationization of claim 1 wherein the second chemical impregnation tank disposed at a second angle with respect to a position of the first chemical impregnation tank depending on a desired degree of the turning unit and if the turning unit is place between the tanks.

11. The system for cationization of claim 1 further comprising a fabric winding assembly adapted to receive and wind the fabric after the fabric has exited the second impregnation chemical tank, the assembly having an A-frame and a winder rotatably connected to the A-frame, the winder having an outer surface having a plurality of upwardly extending needles, wherein each of the needles having a hook portion at an outer rope end adapted to grab the fabric such that the winding assembly is self-catching and winding assembly can be started/threaded with respect to an initial fabric on a center beam of the A-frame without human intervention.

12. The system for cationization of claim 11 wherein the A-frame is positioned on a movable floor guided by a center winder sensor of the fabric winding assembly so that winding by the winding assembly is centered to avoid air pockets and allow for fabric edge on edge winding.

13. The system for cationization of claim 1 wherein the first impregnation tank, the turning unit and the second impregnation tank are enclosed within a housing, the housing having an exhaust fan and outlet for worker safety with a control panel place outside of an enclosed area defined by the housing.

14. The system for cationization of claim 7 further comprising a second blowing unit adapted to balloon the fabric impregnated with the multi-functional reaction fluid after it exits the second impregnation tank for even penetration and preventing wrinkles before or as the fabric goes into a second squeeze; wherein the spreaders are adapted to automatically regulate the width of the fabric using information received from the sensors.

15. The system for cationization of claim 1 wherein the multi-functional reaction fluid is adapted to bond to the cellulose or cellulosic blended fabric as the fluid slowly warms up and over time with further warming up of the fluid one or more positive charge sites are created on the fabric and are adapted to bond with negative charge sites of a fabric dye during a dyeing process for the fabric.

16. The system for cationization of claim 1 further comprising a mixer having an outlet in fluid communication with the first chemical impregnation tank, the mixer adapted to introduce the cold multi-functional reaction fluid into the first interior area of the first chemical impregnation tank.

17. The system for cationization of claim 10 wherein the second angle is between about 45-90° degree.

18. The system for cationization of claim 11 wherein the A-frame is positioned on a movable floor guided by a sensor of the fabric width on the A-frame so the pressure on the fabric winding is even and not too tight.

19. The system for cationization of claim 1 further comprising a covering adapted to create a "closed" system and minimize or prevent exposure to any vapors created by chemical reaction of the reaction fluid; wherein further comprising a control panel adapted to control operation of the system with the control disposed on an elbow arm device or mounted outside an area enclosed by the covering; wherein the tanks are enclosed by the covering and the covering is provided with an exhaust system.

20. The system for cationization of claim 19 wherein the exhaust system is adapted for dyeing of the cationized cellulosic fabric and adapted to permit a dyeing cycle treatment that includes washing, bleaching, dyeing, neutralization with a finishing pH of 5.7-5.9, with current chemistry; wherein the treatment adapted to also include an addition of boric acid as a scent preventing agent which is adapted to prevent degradation of TMA and a fishy smell during textile drying.

21. The system for cationization of claim 1 wherein an ionic cross-linked cationic fibrous material in the raw greige fabric from a cold pad-batch method comprises mono functional or multifunctional cationic polymer induced with an epoxy chain attaching to the cellulosic fibers in a high alkali solution comprising a mono cationic polymer 2,3-epoxypropyl trimethyl ammonium chloride (EPTAC) with the EPTAC formed from 3-chloro-2-hydroxypropyl trimethyl ammonium chloride (CHTAC) with an alkali, sodium hydroxide (NaOH) and boric acid provided during a dyeing process with the boric acid adapted to prevent TMA degradation and prevent a permanent fishy smell.

22. The system for cationization of claim 14 further comprising a first squeezing rollers unit with pressure control pistons positioned above the first air blowing unit and the first chemical impregnation tank, wherein the first squeezing rollers unit adapted to squeeze the fabric impregnated with the multi-functional reaction fluid fed from the first impregnation tank prior to being received by the turning unit.

23. The system for cationization of claim 22 further comprising a second squeezing rollers unit positioned above the second air blowing unit and the second chemical impregnation tank, wherein the second squeezing rollers unit adapted to squeeze the fabric impregnated with the multi-functional reaction fluid fed from the second chemical impregnation tank.

* * * * *